US005913751A

United States Patent [19]

Eschenbach

[11] Patent Number: 5,913,751

[45] Date of Patent: Jun. 22, 1999

[54] WALKER EXERCISE APPARATUS WITH ARM EXERCISE

[76] Inventor: Paul William Eschenbach, 143 Lakeland Ave., Moore, S.C. 29369

[21] Appl. No.: 08/947,959

[22] Filed: Oct. 9, 1997

[51] Int. Cl.[6] ..... A63B 69/16; A63B 22/00

[52] U.S. Cl. ..... 482/57; 482/51

[58] Field of Search ..... 482/51, 52, 53, 482/57, 62, 70, 79, 80, 74, 71; 434/255

[56] References Cited

U.S. PATENT DOCUMENTS

| | | | |
|---|---|---|---|
| 4,915,375 | 4/1990 | Ginsburg | 482/57 |
| 5,575,739 | 11/1996 | Piaget et al. | 482/51 |
| 5,611,756 | 3/1997 | Miller | 482/57 |
| 5,683,333 | 11/1997 | Rodgers | 482/51 |
| 5,800,315 | 9/1998 | Yu et al. | 482/57 |
| 5,823,919 | 10/1998 | Eschenbach | 482/62 |

*Primary Examiner*—Stephen R. Crow

[57] ABSTRACT

A standup exercise apparatus simulates walking and jogging with arm exercise. Foot pedals move with a back and forth movement while the pedals are inclined with the toe above the heel during the latter portion of forward movement of the foot while the heel is inclined above the toe during the latter portion of rearward movement of the foot. Foot pedals move with smooth elliptical motion resulting from a linkage mechanism having smooth orbital motion without the characteristic turnaround jerk associated with reciprocating member elliptical drives. Leg joint impact is controlled to be very low as to allow extended exercise without joint soreness. Arm exercise is coordinated with motion of the feet.

20 Claims, 4 Drawing Sheets

WALKER EXERCISE APPARATUS WITH ARM EXERCISE

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Various attempts to provide a walking motion during standup pedal exercise are on the market today which provide a pendulum motion to the feet similar to Bull et al. in U.S. Pat. No. 4,940,233 that shows a swing arm with pedal attached so the foot reciprocates along an arcuate path. These swinger type exercise apparatus do not simulate a true walking motion because the foot returns along the same arcuate path without lifting as in actual walking. There is a need for a standup exercise apparatus having pedals which guide the feet along an elongate curve path while inclining the feet as experienced during walking. There is a further need to combine arm exercise with the improved walking motion.

Hand cranks and swing arms have long been applied to arm exercise. More recently swing arms have been more popular in commercial and home exercise equipment.

Swing arms for arm exercise are used by Carlson et al. in U.S. Pat. No. 4,772,015 to arm wrestle while Carlson in U.S. Pat. No. 4,720,099 adapts swing arms for a variety of arm and leg motions in one machine. Iams et al. in U.S. Pat. No. 4,674,740 applies spring loaded handles in a prone platform supporting position to simulate the arm motion of swimming. Berne in U.S. Pat. No. 2,921,791 and McGillis et al. in U.S. Pat. No. 4,872,668 use articulated arms for various arm exercise.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup pedaling approaches the benefits of running to the cardiovascular system because a higher load resistance is possible over sit down cycling. Dr. Cooper in his book entitled THE AEROBICS PROGRAM FOR TOTAL WELL-BEING by Dr. Kenneth Cooper, Bantam Books, New York, 1982 awards only half the benefit points to sit down stationary cycling (page 260) over regular cycling which includes an equal amount of uphill and down hill course (page 255). Dr. Cooper grades running better than regular cycling, but without the downhill rest inherent in regular cycling, it is certain that standup cycling with vigorous arm exercise would exceed running for cardiovascular benefits in less time.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, AL where pedal platforms move by dual crank motion but remain parallel to the floor. Knudsen in U.S., Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

A Passive-Motion Walking-Machine is shown by Blend in U.S. Pat. No. 219,439 having foot pedals guided by rollers which follow a curved track. Both front and rear pivots follow the same path as the foot pedal moves forward until the front rollers reach a switch plate at the forward end of the pedal cycle. The front rollers move up the inclined switch plate to roll over the rounded end to drop upon a lower track to begin the return cycle to the rear. Since the front rollers use the same track or guide path as the rear rollers through most of the pedal cycle, the pedal pivots are not guided by two separate different pivot guide curves. Furthermore, the switch plate is unidirectional for a non-reversable pedal cycle. It is an object of this invention to guide the pedals with walking motion where the feet incline as in walking with the heel above the toe in the rearward portion of the foot motion while the toe is above the heel during the forward portion of the foot motion.

Recently, several elliptical exercise machines have appeared in the patent literature. Rogers, Jr. in U.S. Pat. Nos. 5,529,555, 5,540,637 and 5,549,526 shows elliptical pedal motion by virtue of various reciprocating members and a geared linkage system. Miller in U.S. Pat. Nos. 5,518,473 and 5,562,574 also shows elliptical pedal motion using reciprocating members and slider-crank mechanisms. Additional patents by Miller in U.S. Pat. Nos. 5,577,985 and 5,611,756 deal with elliptical pedal motion using oscillating guide links with control links to determine pedal angles.

The Elliptical Cross Trainer by Life Fitness of Franklin Park IL, recently introduced to the Club Industry in San Francisco during April, 1997, also generates elliptical pedal motion using an elongated pedal supported by rollers on one end and a crank having orthogonal slots with rollers on the other. None of these elliptical exercise machines anticipate pedal inclines common to walking of the present invention.

It is one objective of this invention to provide a simplified linkage system that causes the pedal to move with elliptical motion. Another object of this invention is to provide pedals that incline the foot to simulate walking or jogging.

There is a need for a pedal operated quiet exercise machine that can be safely operated in the standup position whereby the arms and legs can be exercised with the feet moving through a generally elliptical path while the pedals move with a smoothly changing angular motion during the pedal cycle.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal being pivotally supported by a foot support link which is pivotally attached to a rocker link being pivoted to the framework. The foot support link is pivotally attached to a rotary crank which completes one full revolution during a pedal cycle and is phased generally opposite the crank for the other foot support link through a bearing journal attached to the framework. A coupler/connector link is pivotally connected to the pedal and to the rocker link. Arm exercise is coordinated with the pedal motion by upward extension of the rocker links.

In an alternate embodiment, the connector link is attached to the crank at a pivot different than the pivot attaching the foot support link. The rocker link has been replaced with a roller and track to guide one end of the support link.

In both embodiments, the pedal is moved by the foot of the user where the pivot common to the foot support link and the pedal follows an elongate curve path while the connector link inclines the pedal with the heel above the toe during the rearward portion of the elongate curve path and inclines the foot with the toe above the heel during the forward portion of the elongate curve path.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having motions that simulate walking and jogging with very low joint impact while offering naturally inclining pedal motion and upper body exercise.

DETAILED DESCRIPTION OF THE EMBODIMENTS

Figure 1:
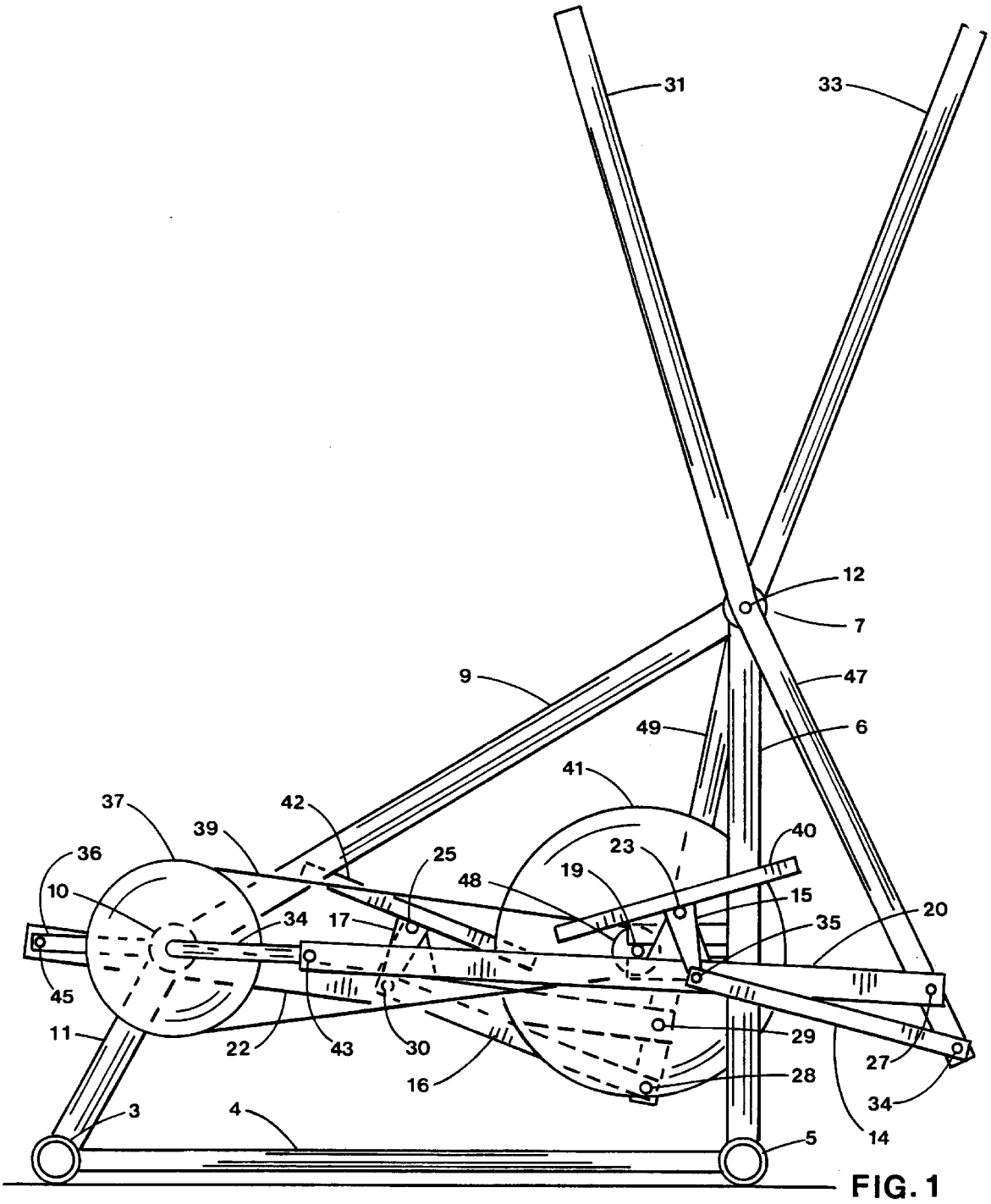
FIG. 1 is a right side elevation view of the preferred embodiment of an exercise machine constructed in accordance with the present invention.
Figure 2:
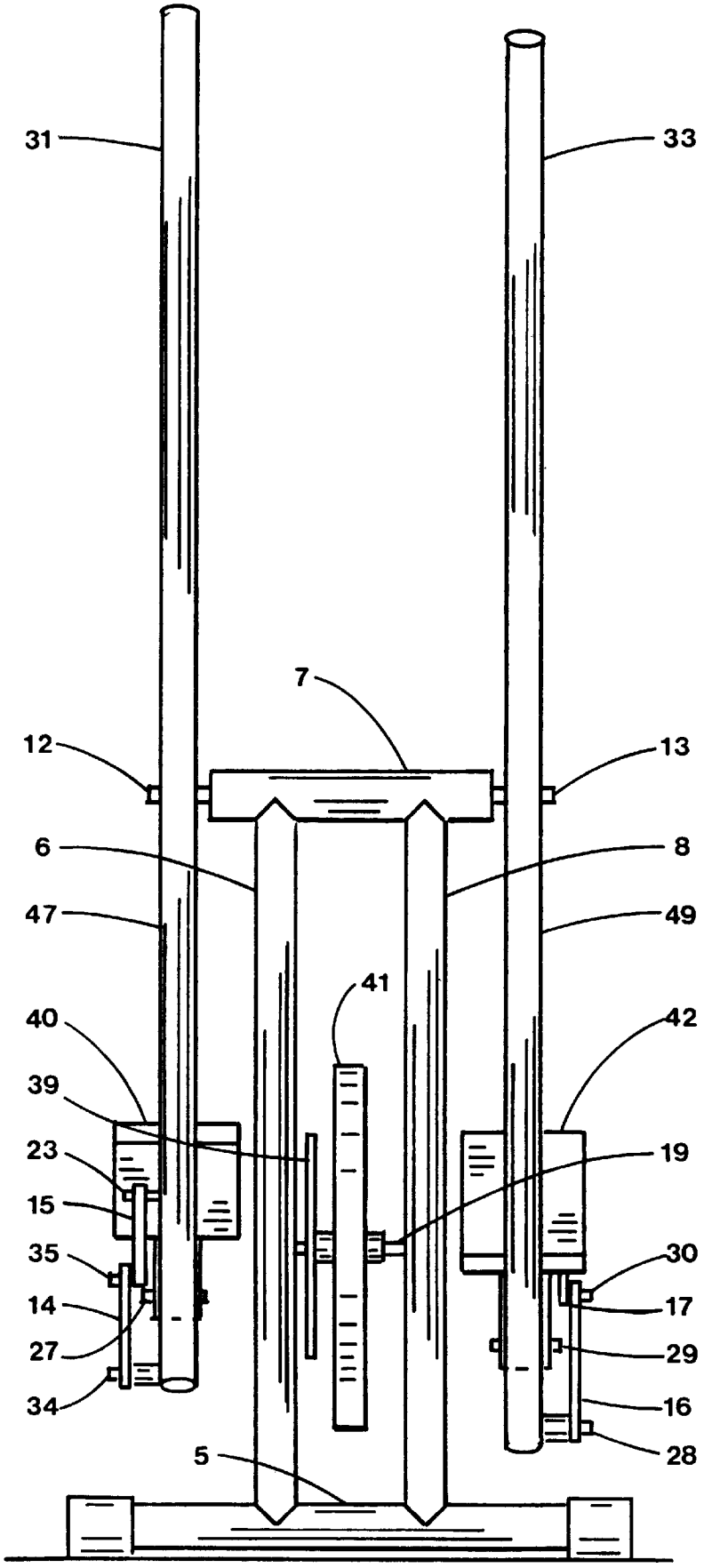
FIG. 2 is the front view of the preferred embodiment shown in FIG. 1.

Referring to the drawings in detail, pedals 40 and 42 are shown in FIGS. 1 and 2 in the most forward and rearward positions of the preferred embodiment. Pedals 40 and 42 are are pivoted to foot support links 20,22 at pivots 23,25. Foot support links 20,22 are connected to cranks 34,36 on one end at pivots 43,45 and are connected to rocker links 47,49 at pivots 27,29 at the other end. Rocker links 47,49 are connected to frame crossover member 7 at pivots 12,13 and extend upward as arm levers 31,33 for arm exercise. Cranks 34,36 are joined inside bearing housing 10 and protrude outward in generally opposing directions. Pedal extensions 15,17 are connected to rocker links 47,49 by connector links 14,16 at pivots 34,35 and 28,30.

Frame member 4 connects cross members 3,5 which contact the floor for support of the exercise machine. Frame members 6,8 connect cross member 5 to crossover member 7 while frame member 9 connects crossover member 7 to bearing housing 10 which is connected to cross member 3 by frame member 11.

Load resistance is imposed upon cranks 34,36 by pulley 37 which drives flywheel/alternator 41 by belt 39 coupled to pulley 48 which is supported by the frame at shaft 19.

Figure 3:
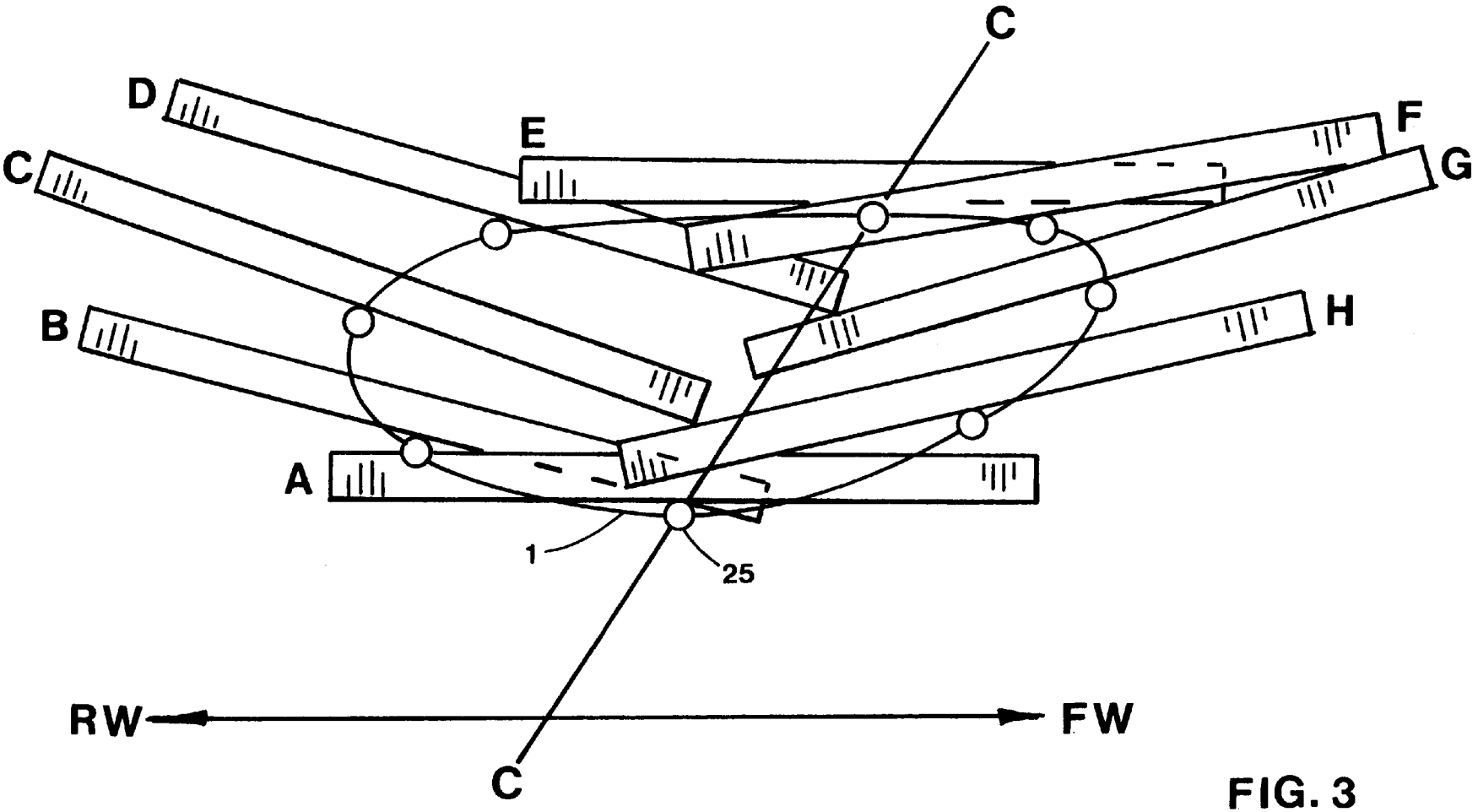
FIG. 3 is a right side elevation view of pedal inclines during foot motion of the preferred embodiment shown in FIG. 1.

Application of body weight on the pedals 40,42 causes the pedal pivots 23,25 to follow elliptical curve 1 shown in FIG. 3 and together with force applied at the arm levers 31,33 cause the linkage to rotate the flywheel 41 for a gain in momentum. This flywheel 41 momentum will carry the linkage system through any dead center positions of the crank 34,36. The pedals 40,42 and arm levers 31,33 can be operated to drive the flywheel 41 in either direction of rotation.

FIG. 3 shows pedal positions A–H as the pedal pivot 25 follows the elongate closed loop curve path 1. Depending upon the proportions of the crank 34, foot support link 20, rocker link 47 and the location of pivot 12, the elongate curve path is generally elliptical in shape. Pedal 40 inclines the toe of the foot below the heel in rearward positions B,C,D and inclines the toe above the heel in forward positions F,G,H. Positions A and E are generally horizontal in the mid-section of the elongate curve path where a line C—C drawn through the pivots separates the forward FW and rearward RW portions of the elongate curve path. The angular movement of pedal 40 more closely simulates the motions of walking than previous elliptical exercise machines.

Figure 4:
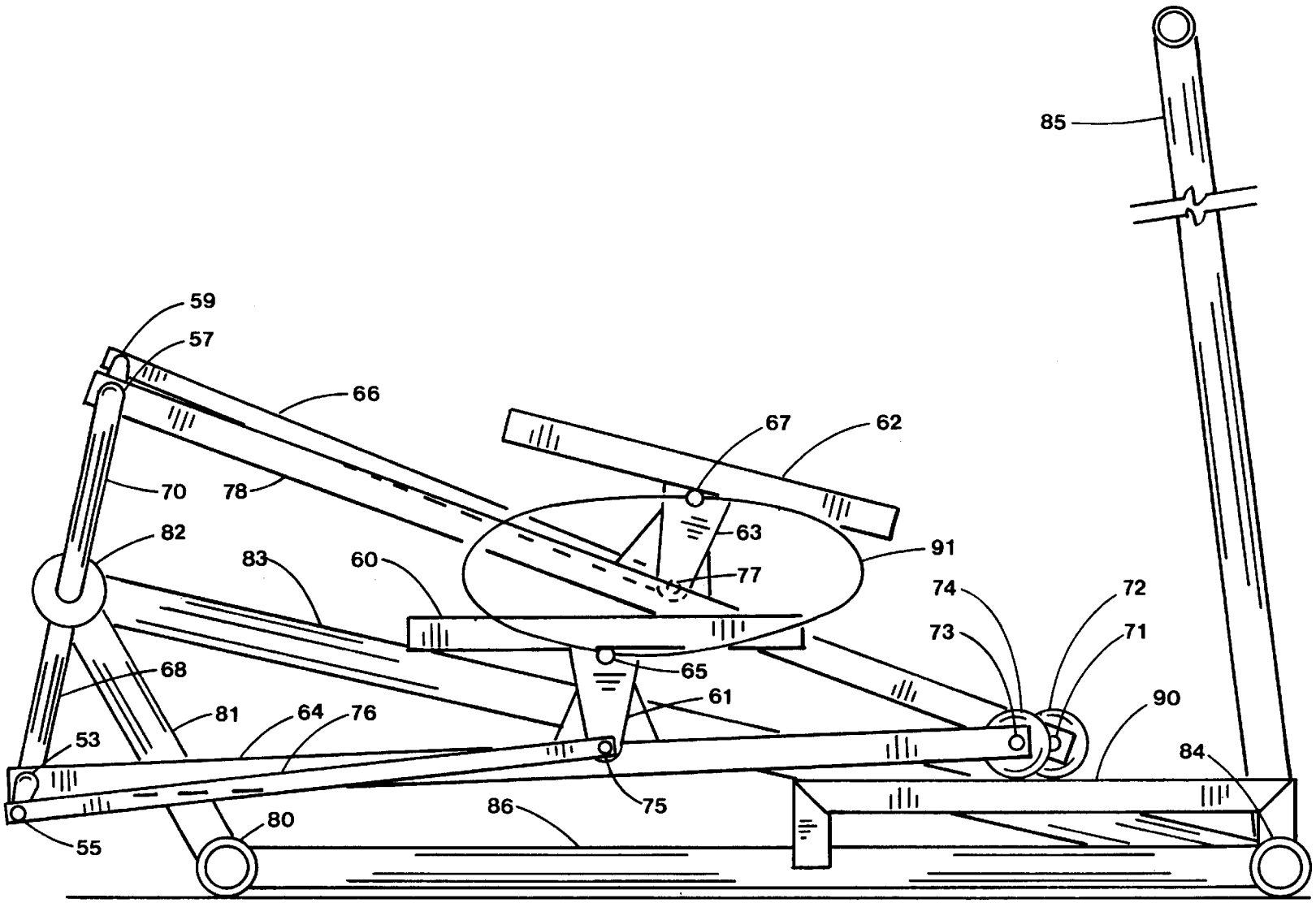
FIG. 4 is a right side elevation of the alternate embodiment.

An alternate embodiment is shown in FIG. 4 with pedals 60,62 in their lower and uppermost positions. Pedals 60,62 are pivoted to foot support links 64,66 at pivots 65,67. Foot support links 64,66 are attached to cranks 68,70 on one end at pivots 53,57 with the cranks 68,70 being connected inside bearing housing 82. Foot support links 64,66 are connected to rollers 74,72 at pivots 73,71 on the other end. Rollers 74,72 ride on tracks 90,92 which are connected to frame members 86,88. Tracks 90,92 are shown horizontal but can be inclined and adjustable. Bearing housing 82 is connected to cross member 80 by member 81 and to cross member 84 by member 83. Cross members 80 and 84 are connected by members 86,88.

Pedal extensions 61,63 are coupled to crank pivots 55,59 and pedal extension pivots 75,77 by connector links 76,78. Crank pivots 55,59 are offset to cranks 68,70 through foot support links 64,66 by pivots 53,57. Handle 85 is connected to cross member 84 to balance the operator; however, it is understood that arm exercise can be adapted to this embodiment as well. Load resistance is not shown for clarity but would be configured to act upon cranks 68,70 similar to the first embodiment.

Application of body weight upon pedals 60,62 produces the elongate curve path 91 and pedal positions similar to the first embodiment as shown in FIG. 3.

In summary, the present invention has distinct advantages over prior art because the angular movement of the pedals more closely simulate the incline foot motions of walking than previous elliptical exercise machines offered.

What is claimed is:

1. An exercise machine comprising;

a framework means, said framework means configured to be supported on the floor;

a linkage means, said linkage means having a plurality of links operably associated with said framework means including a crank means pivotally connected to said framework means, said crank means projecting outwardly therefrom on both sides thereof;

a coupler means operably associated with said linkage means;

a foot support means operably associated with said linkage means, said foot support means configured to move with a generally back and forth movement following an elongate curve path, said elongate curve path having forward and rearward ends;

a pedal means to support each foot, said pedal means operably associated with said foot support means and said coupler means to allow said pedal means to move relative to said foot support means when the foot of the user is rotating said linkage means whereby said pedal means causes the heel of the foot to rise faster than the toe before the rearward end of said elongate curve path and the heel of the foot to lower faster than the toe before the forward end of said elongate curve path to simulate a walking motion.

2. The exercise machine according to claim 1 wherein said linkage means includes a rocker means pivotally connected to said framework means and pivotally connected to said foot support means.

3. The exercise machine according to claim 1 wherein said linkage means includes a roller means pivotally attached to said foot support means and operably associated with a track means attached to said framework means.

4. The exercise machine according to claim 2 wherein said coupler means is a connector link pivotally interposed between said pedal means and said rocker means.

5. The exercise machine according to claim 1 wherein said coupler means is a connector link pivotally interposed between said crank means and said pedal means.

6. The exercise machine according to claim 4 wherein said pedal means comprises a foot engaging link pivotally connected to said foot support means having a pedal link extension pivotally attached to said connector link.

7. The exercise machine according to claim 1 further comprising an arm exercise means operably associated with said linkage means.

8. The exercise machine according to claim 1 further comprising a load resistance means operably associated with said crank means.

9. The exercise machine according to claim 1 wherein said elongate curve path has a generally elliptical shape.

10. An exercise machine comprising;

a framework means, said framework means configured to be supported on the floor;

a linkage means, said linkage means having a plurality of links operably associated with said framework means including a crank means pivotally connected to said framework means, said crank means projecting outwardly therefrom on both sides thereof;

a pedal means to support each foot, said pedal means operably associated with said linkage means, said pedal means coordinated with said linkage means to allow said pedal means to move along a closed loop curve path relative to said framework means when the foot of the user is rotating said linkage means whereby said pedal means causes the foot to incline with the toe generally below the heel during substantially the rearward portion of said closed loop curve path and causing the foot to incline with the toe generally above the heel during substantially the forward end of said closed loop curve path.

11. The exercise machine according to claim 10 wherein said linkage means includes a rocker means pivotally connected to said framework means and pivotally connected to said foot support means.

12. The exercise machine according to claim 11 wherein said linkage means includes a connector link pivotally interposed between said pedal means and said rocker means.

13. The exercise machine according to claim 10 wherein said linkage means includes a connector link pivotally interposed between said crank means and said pedal means.

14. The exercise machine according to claim 10 wherein said linkage means includes a roller means pivotally attached to said foot support means and operably associated with a track means attached to said framework means.

15. The exercise machine according to claim 10 further comprising an arm exercise means operably associated with said linkage means.

16. The exercise machine according to claim 10 further comprising a load resistance means operably associated with said crank means.

17. An exercise machine comprising;

a framework means, said framework means configured to be supported on the floor;

a crank means pivotally connected to said framework means, said crank means projecting outwardly therefrom on both sides thereof;

a link means, said link means pivotally attached to said framework means;

a foot support means, said foot support means pivotally interposed between said crank means and said link means;

a pedal means for each foot of the user, said pedal means pivotally attached to said foot support means and operably associated with said link means;

said pedal means coordinated with said link means to allow said pedal means to move relative to said framework means in a generally back and forth elliptical movement when the foot of the user is rotating said foot support means whereby the pedal means causes the foot to incline with the toe generally below the heel during the back end of said pedal movement and causing the foot to incline with the toe generally above the heel during the forward end of said pedal movement to simulate movements common to walking.

18. The exercise machine according to claim 17 further comprising a connector link pivotally interposed between said link means and said pedal means.

19. The exercise machine according to claim 17 further comprising an arm exercise means operably associated with said link means.

20. The exercise machine according to claim 17 wherein said pedal means follows a closed loop elongate curve path as the foot of the user rotates said crank means.

* * * * *